United States Patent [19]

Seko et al.

[11] Patent Number: 4,818,003

[45] Date of Patent: Apr. 4, 1989

[54] DOOR HANDLE DEVICE FOR A DOOR OF AN AUTOMOTIVE VEHICLE

[76] Inventors: Osamu Seko, 401-1, Takakura, Fujisawa-shi, (Kanagawa-ken), 252; Masaichi Moriya, 14-2-202, Tsurugadai, Chigasaki-shi, (Kangawa-ken), 253, both of Japan

[21] Appl. No.: 946,601

[22] Filed: Dec. 23, 1986

Related U.S. Application Data

[63] Continuation of Ser. No. 742,136, Jun. 7, 1985, abandoned, which is a continuation of Ser. No. 448,852, filed as PCT JP82/00131 on Apr. 20, 1982, published as WO82/03650 on Oct. 28, 1982, abandoned.

[30] Foreign Application Priority Data

Apr. 21, 1981 [JP] Japan ..... 56-60038

[51] Int. Cl.[4] ..... E05B 3/00

[52] U.S. Cl. ..... 292/336.3; 16/112; 16/286; 74/543; 292/DIG. 31; 292/DIG. 38

[58] Field of Search ..... 292/336.3, DIG. 30, 292/DIG. 31, DIG. 38, 357, DIG. 71, DIG. 63, 165, 167, 123, 223; 70/207–209; 16/112, 286; 74/543

[56] References Cited

U.S. PATENT DOCUMENTS

| | | | |
|---|---|---|---|
| 687,703 | 11/1901 | Swope | 292/167 X |
| 947,528 | 1/1910 | Hunter | 292/336.3 |
| 1,287,830 | 12/1918 | Bartholomew | 292/DIG. 31 |
| 1,417,239 | 5/1922 | Forbes | 292/165 X |
| 2,068,606 | 1/1937 | McPherson | 292/357 |
| 2,129,926 | 9/1938 | Geske et al. | 292/DIG. 71 |
| 2,348,065 | 5/1944 | George . | |
| 2,721,751 | 10/1955 | Holritz | 292/336.3 |
| 3,081,617 | 3/1963 | McKay | 292/336.3 |
| 3,153,553 | 10/1964 | Sandor | 292/336.3 |
| 3,361,463 | 1/1968 | Russell et al. | 292/165 |
| 3,668,907 | 3/1972 | Pastva, Jr. . | |
| 4,205,867 | 6/1980 | Loikitz | 292/223 |
| 4,422,677 | 12/1983 | Gater | 292/167 X |
| 4,497,514 | 2/1985 | Moriya et al. | 16/112 X |
| 4,648,639 | 3/1987 | Martin et al. | 292/167 |

FOREIGN PATENT DOCUMENTS

| | | | |
|---|---|---|---|
| 1940662 | 2/1971 | Fed. Rep. of Germany | 292/DIG. 31 |
| 2363060 | 6/1975 | Fed. Rep. of Germany . | |
| 2534283 | 2/1976 | Fed. Rep. of Germany | 292/336.3 |
| 997943 | 9/1951 | France | 292/167 |
| 90770 | 11/1937 | Sweden | 292/165 |
| 443659 | 3/1936 | United Kingdom | 292/165 |
| 1306368 | 2/1973 | United Kingdom . | |
| 1408313 | 10/1975 | United Kingdom . | |

*Primary Examiner*—Lloyd A. Gall

[57] ABSTRACT

An inside handle device for an automotive vehicle door in which a compression spring (18) for urging a handle (8) to its closed position is provided in an air gap (17*a*) in a bracket member (7) pivotally securing the handle (8) to reduce the size of the entire device and to simplify the assembly. The handle (8) is pivotally secured to the bracket member (7) which is secured to a door panel (15), and is connected via a connecting rod (3) to a door locking mechanism.

8 Claims, 2 Drawing Sheets

DOOR HANDLE DEVICE FOR A DOOR OF AN AUTOMOTIVE VEHICLE

This application is a continuation of application Ser. No. 742,136, filed June 7, 1985, now abandoned, which is a continuation of Ser. No. 448,852, filed as PCT JP82/00131 on Apr. 20, 1982, published as WO82/03650 on Oct. 28, 1982, now abandoned.

FIELD OF THE INVENTION

The present invention relates to a door handle device for opening or closing a door of an automotive vehicle, and more particularly, an inside handle device for opening or closing the door from within a passenger compartment.

BACKGROUND OF THE INVENTION

Conventional inside handle devices comprise a handle pivotably secured to a bracket fixed on a door inner panel of a vehicle body, and a connection rod for connecting the handle to a door lock mechanism. A compression spring is inserted between the bracket and a spring seat provided on the connection rod so as to urge the handle towards the closed position. Further, the inside handle device includes an inside handle escutcheon which is adapted to cover the connected elements, i.e., the compression spring, handle and connection rod, and the bracket.

In the above mentioned inside handle device, however, since the bracket and the compression spring disposed outside of the bracket are covered with the escutcheon, it is difficult to reduce the size of the escutcheon. Therefore, this makes it difficult to reduce the size of the inside handle device. However, recent vehicle bodies need to be compact and light so that the inside handle should also preferably be compact.

Furthermore, in conventional devices, unpleasant noises such as a squeaking sounds may be generated by the rubbing between the connection rod and the compression spring. Thus, this drawback also needs to be resolved.

In addition to the above matter, in conventional devices, it is necessary to form a projection by which to fix the spring seat on the connection rod or some other fixing means to fix the spring seat onto the connection rod. Furthermore, it is also necessary to engage the handle with the connection rod which is previously assembled with the compression spring and spring seat. Accordingly, processing and assembly will be complicated, thereby resulting in poor manufacturing efficiency.

Therefore, it is an object of the present invention to provide a door handle device which can overcome the disadvantages described with reference to the above conventional devices.

In addition, it is a more specific object of the present invention to provide a door handle device, the size of which can be decreased and the assembly process for which can be simplified by arranging a spring to urge a handle to the closed position in a bracket supporting the handle pivotably.

SUMMARY OF THE INVENTION

To accomplish the above described or other objects, the door handle device according to the present invention comprises a handle which is pivotably secured to a bracket fixed to a door panel, a spring housing space which is formed in the bracket along a tangent line in contact with a locus caused by rotating the base end of the handle, one end of the spring housing space being closed and the other end being overlapped with the rotated locus of the base end of the handle, a compression spring which is compressedly disposed in the spring housing space so as to contact one end of the spring to the closed end and the other end to the base end of the handle, and a rod for connecting the base end of the handle and a door lock mechanism.

In accordance with a preferred embodiment of the present invention, a door handle device comprises a door lok mechanism, a handle which is connected to the door lock mechanism so as to operate the lock mechanism, means for pivotably supporting the handle onto a door panel, and an urging means for urging the handle towards the normal position, the urging means being housed in the supporting means.

Further, it is preferable that the handle and the supporting means are composed of a hard synthetic resin such as poly acetal.

DISCLOSURE OF THE PREFERRED EMBODIMENT

Figure 1:
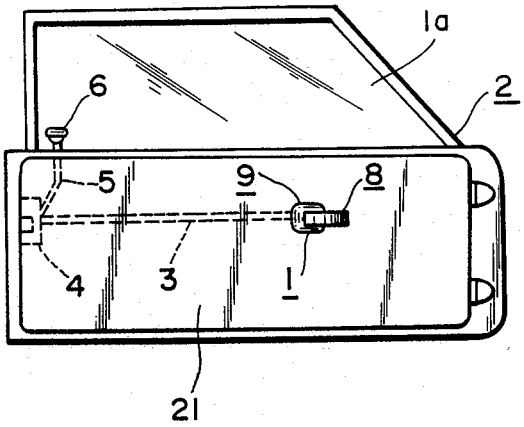
FIG. 1 is an elevational view of a vehicle door equipped with a preferred embodiment of an inside handle device according to the present invention.

Hereinafter, a preferred embodiment of the present invention will be explained with reference to the drawings. FIG. 1 shows a vehicle door 2 which is equipped with an inside handle device 1 according to a preferred embodiment of the present invention, in which a handle 8 of the inside handle device is connected to a well-known door lock mechanism 4 via a connection rod or link 3. On the other hand, the door lock mechanism 4 is connected to a door lock knob 6 via another connection rod or link 5. These connection rods 3 and 5 are housed within a space 2a defined by a door inner panel 15 and a door trim 21. The handle 8 and the connection point of the connection rod 3 are covered by an inside handle escutcheon 9 which fits within an opening 22 formed in the door trim 21.

As is well known, the door lock mechanism 4 includes a latch mechanism for holding the door in the closed position and a lock mechanism for locking the door in the closed position. The connection rod 3 is connected to a control lever of the latch mechanism and the connection rod 5 is connected to a control lever of the lock mechanism. In the embodiment shown in the drawings, the door lock knob 6 is so arranged as to protrude into a window area 1*a* from the top edge of the door such that the lowermost position of the knob corresponds to the locked position of the lock mechanism and the uppermost position corresponds to the unlocked position. The latch mechanism is elastically urged toward the un-latched position and in the door closed position, engages a striker (not shown) disposed in the vehicle body so that the engagement between the striker and a latch plate is held by a locking plate. Thus, the door is latched in the closed position. Therefore, the handle 8 of the inside handle device 1 is normally elastically urged toward the position indicated by solid lines in FIG. 3 (hereinafter referred to as the "normal position"). On the other hand, when the handle is rotated about a pivotably supported point toward the position indicated by phantom lines in FIG. 3 (hereinafter, referred to as the "door opening position"), the engagement between the latch plate of the latch mechanism and the locking plate is released so that engagement between the latch plate and the striker is also released.

Figure 2:
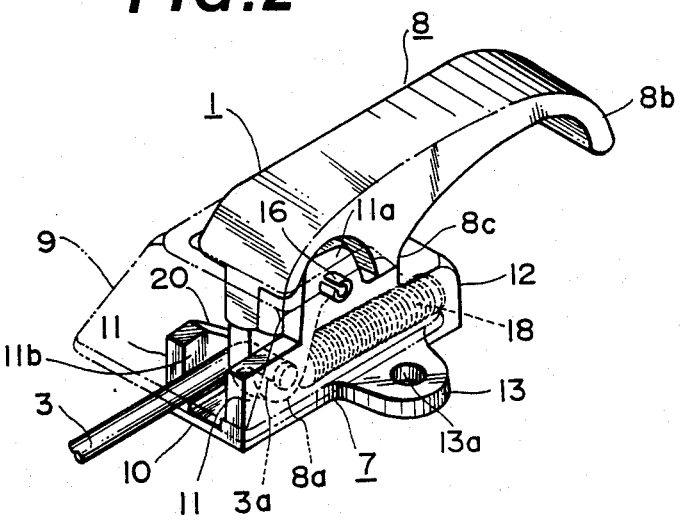
FIG. 2 is an enlarged perspective view of the inside handle device of FIG.1.
Figure 3:
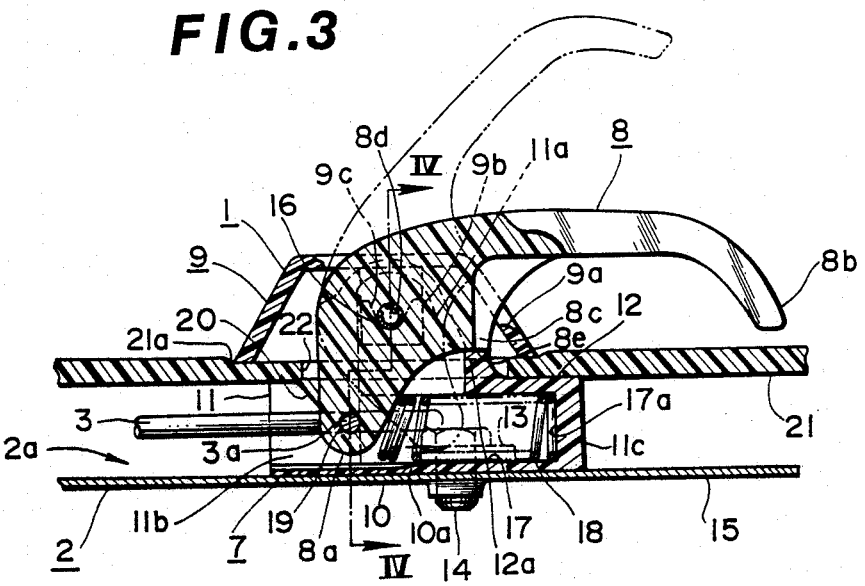
FIG. 3 is a vertical sectional view of the inside handle device of FIG. 2.
Figure 4:
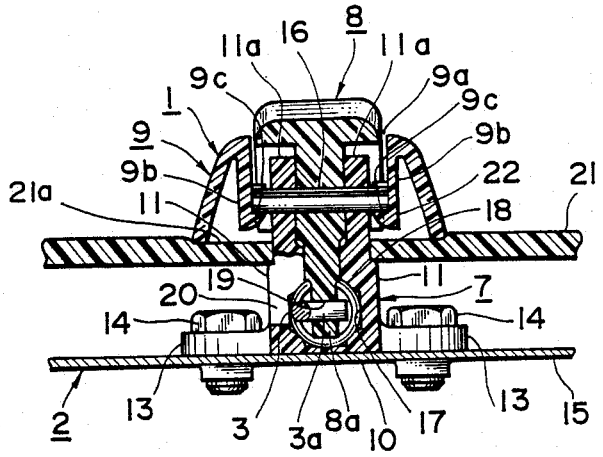
FIG. 4 is a sectional view taken along the line IV—IV of the inside handle device of FIG. 3.

FIGS. 2 to 4 show the inside handle device 1 according to the above described preferred embodiment in detail. The inside handle device 1 mainly comprises the handle 8, a bracket member 7 through which the handle is pivotably supported by the door inner panel 15, and the inside handle escutcheon 9 which closes and covers the opening 22 formed in the door trim 21 through which the handle is inserted. In the preferred embodiment, the handle 8, the bracket member 7, and the escutcheon 9 are all made of a hard synthetic resin such as poly vinyl acetyl. A part or all of the handle, the bracket member, and the escutcheon may be made of metal such as aluminum, so that the material of these members need not be limited to the above-mentioned resin. However, if the components of the inside handle device are made of synthetic resin, the device will be relatively lightweight and simultaneously, it can be effectively prevented from generating noise due to friction between the components.

The bracket member 7 includes a base 10 which is secured to the door inner panel 15, and a pair of pivot supporting portions 11*a* projecting from the base 10. The base 10 is formed with a substantially U-shaped cross-section and fixed to the door inner panel 15 via fixing bolts 14 inserted through holes 13*a* formed in extended portions 13 extending outwards from either side of the bottom 10*a* of the base. Vertical walls 11 are formed at both edges of the bottom 10*a* of the base 10 so as to be isolated from each other and define a groove 11*b* which extends in the longitudinal direction. One end of the groove is closed by another vertical wall 11*c* and a top wall 12 extends from the vertical wall so as to form a blind hole 17*a*. In addition, the free end 12*a* of the top wall 12 is bent outwards. One of the vertical walls 11 is formed with a V-shaped notch 20.

On the other hand, the handle 8 is composed of a grip 8*b* and a pivotably supported portion 8*a*. The free end of the grip 8*b* is bent towards the door trim 21. The pivotably supported portion 8*a* is formed with through holes 8*d* and 19. The through hole 8*d* is so arranged that the axis of the through hole is aligned with that of through holes formed in the pivot supporting portions 11*a* when the pivotably supported portion 8*a* is inserted between the pivot supporting portions 11*a* of the bracket member 7. Thus, the handle 8 is pivotably supported by the bracket member via a pivot 16 which is inserted through the through hole 8*d* and 11*b*. In addition, the pivot 16 is formed with a slit which is aligned in the axial direction of the cylindrical portion of the pivot so as to allow the pivot to have some torsional elasticity. The through hole 19 is formed in the end of the pivotably supported portion 8*a* and engages a crank end 3*a* of the connection rod 3. The end of the pivotably supported portion 8*a* is disposed in the above described groove 11*b*. In addition, the pivotably supported portion 8*a* is formed with an extended surface 8*c* which includes a stopper surface 8*e* facing the free end 12*a* of the top wall 12 of the base 10 of the bracket member 7.

A compression spring 18 is housed within the blind hole 17*a* formed in the bracket member 7 so that one end of the compression spring 18 contacts the vertical wall 11*c* and the other end contacts the end of the pivotably supported portion 8*a* of the handle 8. In this manner, the compression spring 18 urges the handle 8 in the clockwise direction in the drawing via the pivotably supported portion 8*a* so that the handle 8 is held in the normal closed position. In addition, the blind hole 17*a* of the bracket member may be used as a lubrication well.

The inside handle escutcheon 9 has substantially a truncated rectangular-pyramid shape which is formed with an opening 9*a*. Each of the vertical walls 9*b* of the opening 9*a* of the escutcheon 9 is provided with an engaging pawl 9*c* which is adapted to engage a corresponding end of the pivot 16 projecting outwards from the pivot supporting portion 11*a* of the bracket member 7 in order to allow the escutcheon 9 to be secured to the bracket member. In this situation, the external edge of the escutcheon contacts a slightly recessed portion 21*a* formed area the perimeter of the opening 22 of the door trim.

During assembly of the inside handle device composed as disclosed above, first of all, the pivotably supported portion 8*a* of the handle 8 is inserted in the space defined by the pivot supporting portions 11*a* of the bracket member 7 and then, the compression spring 18 is inserted into the blind hole 17*a*. Next, the pivot 16 is inserted through the through holes formed in the pivotably supported portion 8*a* and the pivot supporting portions 11*a* so as to allow the handle 8 to be pivotably supported by the bracket member 7. The assembly of the bracket member 7 and the handle 8 is vertically disposed on the door inner panel, and the V-shaped notch 20 formed in the vertical wall 11 faces the crank end 3*a* of the connection rod 3 so that the crank end 3*a* engages the through hole 19 via the notch. Then, the assembly of the bracket member 7 and the handle 8 is fixed onto the door inner panel 15 by the fixing bolts 14 each of which is inserted through an extended portion 13 of the base 10 of the bracket member 7. The other end of the connection rod is connected to a control lever device for the door lock mechanism 4 before engaging the crank end 3*a*. Thus, the door trim 21 and the escutcheon 9 are secured to the inside of the door inner panel 15.

The end of the pivotably supported portion 8*a* is urged in the clockwise direction in the drawing by the force of the compression spring 18 so that the handle 8 is held in the closed position corresponding to the latch position of the door lock mechanism. In order to release the latch of the door lock, the handle 8 is rotated in the counterclockwise direction indicated by the phantom line in FIG. 3 so that the pivotably supported portion 8*a* is also rotated in the counterclockwise direction while compressing the compression spring 18. Thus, the connection rod 3 is moved rightwards in FIG. 3 and therefore, the latch mechanism of the door lock mechanism is allowed to assume the door opening position. When the handle 8 is released from the operating force, the handle 8 is returned to its normal position by the spring force of the compression spring. In addition, in this stage, overrotation of the handle 8, that is, rotation past its normal position, is prevented by contact between the free end 12*a* of the top wall of the bracket member 7 and the stopper surface 8*e* of the extended surface 8*c* of the pivotably supported portion 8*a*.

In the manner described above, the present invention can provide the following functions and effects:

(1) Since the compression spring 18 can be compressedly disposed in the blind hole 17*a* of the bracket member 7, the spring does not project out of the bracket member as in conventional devices so that the entire device can be made to be more compact.

(2) Assembly can be easily performed. That is, in the conventional process, since the rod is secured to the handle after mounting the spring onto the rod, it is not easy to assemble them. On the other hand, in the present invention, the rod can be secured to the handle independently of the spring and furthermore, the spring is merely inserted alone into the blind hole formed in the bracket member and then the handle is pivotably secured to the bracket member so as to bring the base end of the handle into contact with the free end of the spring. Therefore, each part and assembly can be easily assembled.

(3) The bracket member and the handle can be formed as a single unit from a synthetic resin material. In addition, additional elements such as a spring seat or receptacle as in conventional devices are not required for this invention and, furthermore, specific processing applied to the rod as in conventional devices is also not necessary. Therefore, the device can be easily manufactured.

(4) Since the spring slides along only the internal wall of the blind hole in the bracket made of synthetic resin, and there is no moving contact between metal components or members, the handle can be operated between the opened and closed positions without unpleasant frictional noises or squeaking sounds.

(5) Since the bracket member and the handle are made of synthetic resin, the weight of the device can be decreased.

(6) The use of the blind hole of the bracket member as a lubricant well is additionally convenient.

Although the representative embodiment of the present invention is explained as above, shapes of the bracket member and the handle can be modified as required. In addition to the inside handle of the door, the present invention can be applied to an outside handle.

What is claimed is:

1. A door handle device for a door of an automotive vehicle comprising:

a door lock mechanism operative between a door locking state and a door unlocking state;

a door handle having a pivot portion which as a substantially narrower width in comparison with a grip portion, said door handle being associated with said door lock mechanism at the end portion of said pivot portion and being movable between first and second positions to operate said door lock mechanism respectively at said door locking and door unlocking states;

a supporting means having a base portion secured onto a door inner panel of the automotive vehicle and vertical walls extending from said base portion in parallel to each other, said vertical walls defining a first space having a width substantially equal to the width of said end portion of said pivot portion of said handle for pivotably receiving the latter therein, said base portion defining therein a second space which is in alignment with said first space, and through which second space, said end portion of said pivot portion moves; and a resilient member disposed within said second space and having one end normally contacting said end portion of said pivot portion for constantly biasing said handle towards said first position.

2. The door handle device as set forth in claim 1, wherein said resilient member comprises a compression coil spring, and said second space receiving said resilient member has an inner periphery surrounding said coil spring.

3. The door handle device as set forth in claim 2, wherein said second space has an axis lying in alignment with the axis of a connecting rod for connecting said door lock mechanism and said handle.

4. The door handle device as set forth in claim 1, wherein said handle has a portion mating with a corresponding portion of said supporting means for restricting pivotal movement of said handle in a direction from said first position to said second position.

5. The door handle device according to claim 4, wherein said handle and supporting means are made of hard synthetic resin.

6. A door handle device for a door of an automotive vehicle comprising:

a door lock mechanism operative between a door locking state and a door unlocking state;

a door handle having a pivot portion which has a substantially narrower width in comparison with a grip portion, said door handle being associated with said door lock mechanism at the end portion of said pivot portion and being movable between first and second positions to operate said door lock mechanism respectively at said door locking and door unlocking states;

a supporting means having a base portion secured onto a door inner panel and vertical walls extending from said base portion in parallel to each other, said vertical walls defining a first space having a width substantially to the width of said pivot portion of said handle for pivotably receiving the latter therein, said base portion defining therein a second space which is in alignment with said first space, and through which second space, said end portion of said pivot portion moves;

a pivot extending between said vertical walls for pivotally supporting said door handle within said first space, said pivot having both ends thereof extending from said vertical walls;

a door handle escutcheon having a portion engageable with said ends of said pivot for retaining said escutcheon; and a resilient member disposed within said second space and having one end normally contacting said end portion of said pivot portion for constantly biasing said handle towards said first position.

7. A door handle device for a door of an automotive vehicle comprising:

a door lock mechanism operative between a door locking state and a door unlocking state;

a door handle having a pivot portion which has a substantially narrower width in comparison with a grip portion, said door handle being associated with said door lock mechanism at the end portion of said pivot portion and being movable between first and second position to operate said door lock mechanism respectively at said door locking and door unlocking states;

a supporting means having a base portion secured to a door inner panel and vertical walls extending from said base portion in parallel to each other, said vertical walls defining a first space having a width substantially equal to the width of said pivot portion of said handle for pivotably receiving the latter therein, said base portion defining therein a second space which is in alignment with said first space, and through which second space, said end portion of said pivot portion moves;

a resilient member disposed within the second space and having one end normally contacting said end portion of said pivot portion for constantly biasing said handle towards said first position;

wherein said resilient member comprises a compression coil spring, and said second space receiving said resilient member has an inner periphery surrounding said coil spring;

wherein said second space has an axis lying in alignment with the axis of a connecting rod for connecting said door lock mechanism and said handle; and wherein said handle is pivoted to said vertical walls via pivot pin which has both ends outwardly extending from the outer periphery of said vertical walls, said device further comprising a door escutcheon engaging said ends of said pivot pin with engaging pawls thereof.

8. The door handle device according to claim 7, wherein said pivot pin is a split pin providing torsional elasticity.

* * * * *